United States Patent [19]

Newman

[11] 4,231,605

[45] Nov. 4, 1980

[54] CARRIER ASSEMBLY FOR MULTI-PACK CONTAINERS

[75] Inventor: Fred C. Newman, La Grange, Ill.

[73] Assignee: The Continental Group, Inc., Stamford, Conn.

[21] Appl. No.: 80,373

[22] Filed: Oct. 1, 1979

[51] Int. Cl.[3] ..... B65D 21/02

[52] U.S. Cl. ..... 294/87.2; 206/144; 220/94 R; 294/31.2

[58] Field of Search ..... 294/87.2, 33, 99, 31.2; 224/45 A, 45 AA, 45 AB, 45 BA; 220/94 R, 94 A; 206/144, 142

[56] References Cited

U.S. PATENT DOCUMENTS 3,702,203 11/1972 Oltmanns ..... 294/87.2

FOREIGN PATENT DOCUMENTS 703197 4/1966 Italy ..... 166/144

*Primary Examiner*—James B. Marbert

*Attorney, Agent, or Firm*—John J. Kowalik; Joseph E. Kerwin; Charles E. Brown

[57] ABSTRACT

A multipackage assembly for two large containers each of which has a handle with means for releasably interlocking with each other for holding the upper ends of the containers together, the lower ends of the containers being held together by a releasable band.

10 Claims, 4 Drawing Figures

CARRIER ASSEMBLY FOR MULTI-PACK CONTAINERS

DESCRIPTION OF THE INVENTION

This invention is concerned with an arrangement for connecting a plurality of containers to each other so that they may be readily carried as a single package.

BACKGROUND OF THE ART

Various types of container carriers have been proposed and are in use including baskets and various types of shrink wrapped packages and ties between individual containers.

TECHNICAL FIELD

The field of the invention is in the art of securing the containers to one another such that the containers may be readily carried as a unitary package and yet, wherein the containers may each be separated one from the other for individual use.

DISCLOSURE OF THE INVENTION

This invention pertains to large size containers and is particularly applicable to containers of the two liter to four liter size although they may be used in connection with smaller containers. The invention comprehends the provision of a novel handle for each container so that the containers may be carried away as individual or multiple units, the handles being arranged in such a way that they can be overlapped with one another and can be pinned to each other so as to provide a handle structure for connecting a pair of containers to each other. The invention also comprehends releasably connecting or tying the bottom ends of the two containers with a removable band such as a tape which may be provided with a self-adhering adhesive.

BEST MODE FOR CARRYING OUT THE INVENTION

Figure 1:
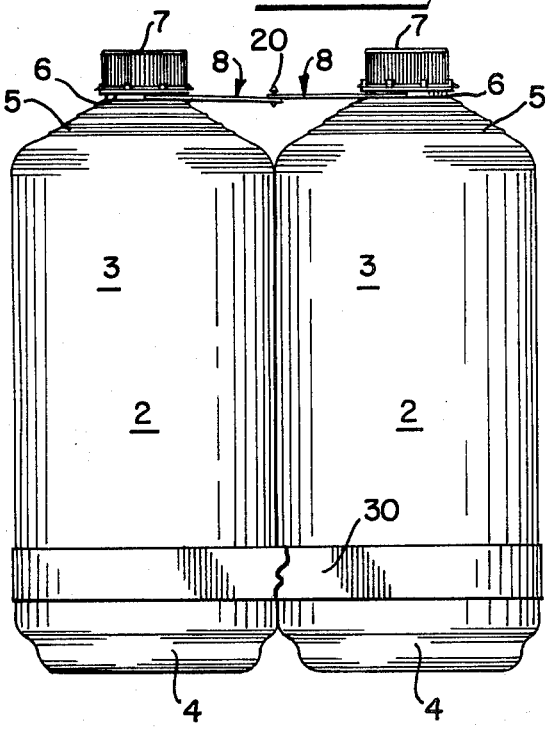
FIG. 1 illustrates a pair of containers connected to each other according to the invention.

The invention is shown in connection with a pair of large size containers designated 2,2 each of which comprises a body 3, a bottom plastic seating portion 4, and a domed upper end 5, to which there is connected a neck 6 preferably of plastic material such as polypropylene or polyethylene or the like. A threaded cap 7 provides a closure for the neck and is threaded on in well-known manner such as shown in U.S. Patent application Ser. No. 892,525 filed Apr. 3, 1978, entitled Closure for Pressure Container (Walter).

Figure 3:
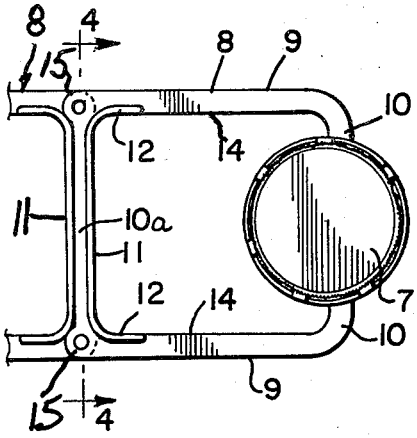
FIG. 3 is a fragmentary top plan view illustrating the overlap of adjacent container handles.
Figure 4:
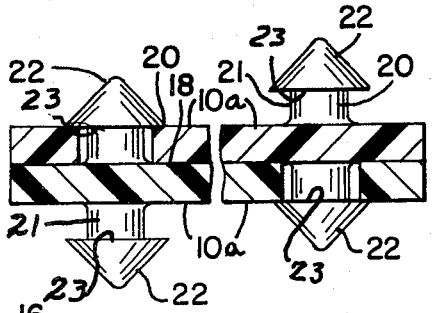
FIG. 4 is an enlarged cross-sectional view taken substantially on the line 4—4 of FIG. 3.

The neck portion has a laterally outwardly extended U-shaped handle 8 which includes a pair of side legs 9,9 with in-turned inner end portions 10,10 which are integrally molded with the neck portion. The outer ends of the leg portions 9,9 are formed with a bite or cross member **10*a* which interconnects the outer ends of the legs 9,9. A reinforcing standing rib 11 is formed along the edge of the cross member 10*a* and has end portions 12,12 which extend on the inner edges 14,14 of the legs 9 a short distance from the outer ends of said legs 9,9. This rib 11 not only reinforces the cross member connection to the legs 9,9, but also provides a wide span grasping area so as to provide a broad surface against which the carrier's hand may be engaged and this prevents its biting into the flesh of the carrier because of the heavy weight of the contents of the container 2. At each end of the cross member 10, there is provided an outwardly extending ear 15 in which there is formed an eye or an aperture 16. As best seen in FIGS. 1 and 3, when the two containers 2 and 2 are brought against each other or placed side by side against each other, the cross members 10*a* overlap each other and the opening 16 in each cross-member lined up with a pin 20 in the cross member of the other handle, it being understood that either handle may be on top or the bottom. The two handle portions 10*a*,10*a* lie flat-faced against each other as at 18, as seen in FIG. 4 in through the openings 16,16, there are inserted pins 20,20, each of which has a cylindrical portion 21 and a outwardly tapered cone-shaped button 22 at each. To connect the two handles, the pins 20 are inserted through the respective aligned opening 16 forcing the respective buttons 22 therethrough the openings. The buttons are larger than the openings and stretch the opening temporarily and then after the shank portion 21 has passed therethrough, the openings reduce in size and the pins are retained in connecting relation with the members 10*a*,10*a*. The buttons 22,22 have their flat inner sides 23 facing toward the respective outer sides of the related portions 10*a*,10*a***.

It can also be readily appreciated that the two handles may be easily connected one to the other and that both members 10,10 when the two containers are connected to one another, serve to form the hand grasping portion.

It will be noted that the containers 2,2 are preferably of thin metal in the nature of 6 to 10 mls. aluminum although they could be plastic and thus, when the connected handles are grasped by their bight portions **10*a*,10*a*, the containers press against each other and slightly flatten along their engaged sides on the cylindrical outer portions 3,3** and thus hold them from uncontrollably sliding laterally.

Figure 2:
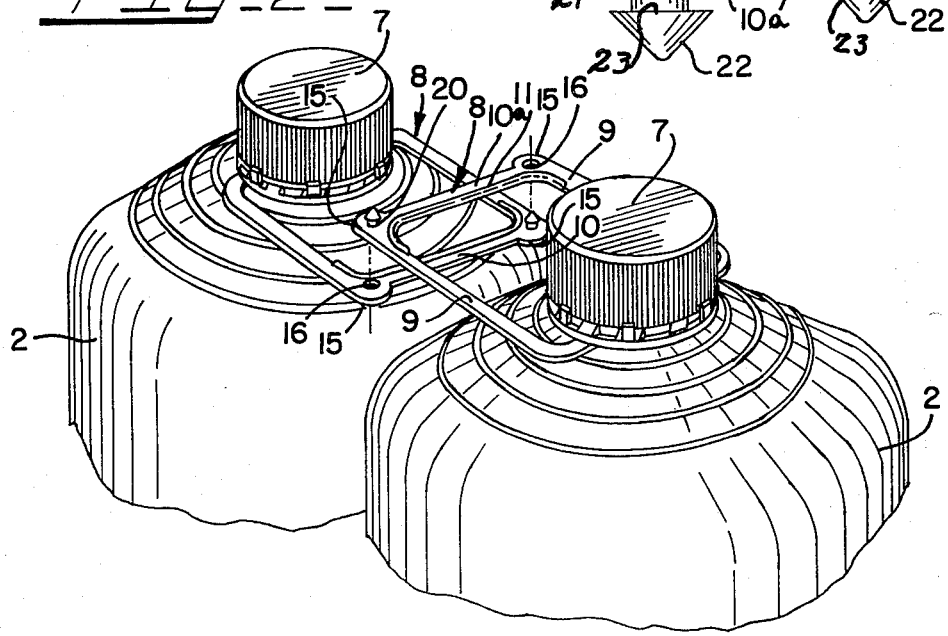
FIG. 2 is a fragmentary perspective view of the upper portion of the containers particularly illustrating the arrangement of the handles.

The lower portions of the containers 2,2 are interconnected or are tied to each other by means of a band of plastic tape designated 30 which may be polyvinylchloride or polyethylene, polypropylene or any of the known resins having a conventional pressure sensitive adhesive thereon by which it is adhered to the tape therebelow. The tape 30 is stretchable and, therefore, when it is applied tightly, it is stretched and imposes a tensile load on the band and also brings the body portions of the containers tightly against each other. In order to disconnect the two containers, the tape 30 is unwrapped and one of the handles is released from the other by disconnecting the pins 20,20 from one or the other handle such as seen in FIG. 2.

Thus a novel and simple and effective structure has been provided for interconnecting two large containers, wherein the handles are so arranged that, upon lifting, they cause the two containers to bear against each other flattening the contour of the cylindrical body portions thus providing a relatively wide surface engagement from one container to the other so as to inhibit lateral shifting conjunctionally of one another, and the tie 30 of the lower portions of the containers serves as an auxiliary medium for inhibiting shifting.

The handles serve as individual handles for the respective containers and are so arranged that they can be easily connected to one another so as to perform a multi-pack assembly.

What is claimed is:

1. A carrier assembly for a pair of containers each of which comprises a body portion having lower and upper end portions;

a handle member connected to the upper end portion, each handle member having a pair of legs extending radially outwardly from the container and a transverse bar portion interconnecting the outer ends of said legs, said bar portions of said pair of containers being arranged in overlapped relationship with one another, and means releasably interconnecting the bar portions of the respective handles to each other to form a common carrier for both containers.

2. The invention according to claim 1 and means for releasably interconnecting the lower portions of said body portions of the containers.

3. The invention according to claim 2 and said means interconnecting the lower portions of the bodies of the containers comprising a tape of resilient elastic plastic material stressed in tension and drawing said bodies toward each other.

4. The invention according to claim 1 and said handles being plastic and said means for interconnecting the bar portions of said handle members comprising transversely aligned apertures in respective bar portions and pins interconnecting said bar portions through the aligned apertures.

5. The invention according to claim 4 wherein said pins each have a head at each end larger than the openings and each bar portion having a reinforcing rib on an inner edge thereof providing large flat hand-engaging areas and said ribs extending along the inner margins of the adjacent legs in a reinforcing relationship thereto.

6. The invention according to claim 1 and said container each having a neck portion of plastic.

7. The invention according to claim 6 wherein said legs have inturned inner portions connected to a neck portion of the container.

8. The invention according to claim 3 wherein said tape comprises a band having overlapped portions with pressure sensitive adhesive to adhere the overlapped portions of said band to each other.

9. The invention according to claim 8 wherein said handle member are made of plastic material.

10. The invention according to claim 1 wherein said handle members are flexible and upon lifting by said bar portion are deflected upwardly thereby causing said containers to bear tightly against one another, each handle member providing a cantilever support for each respective container.

* * * * *